US005097903A

United States Patent [19]

Wilensky

[11] Patent Number: 5,097,903

[45] Date of Patent: Mar. 24, 1992

[54] METHOD FOR RECOVERING INTRACTABLE PETROLEUM FROM SUBTERRANEAN FORMATIONS

[75] Inventor: Joseph Wilensky, Denver, Colo.

[73] Assignee: Jack C. Sloan, Denver, Colo.

[21] Appl. No.: 644,982

[22] Filed: Jan. 23, 1991

Related U.S. Application Data

[63] Continuation-in-part of Ser. No. 410,990, Sep. 22, 1989, abandoned.

[51] Int. Cl.[5] ..... E21B 43/00

[52] U.S. Cl. ..... 166/266; 166/272; 166/303; 166/304; 166/267

[58] Field of Search ..... 166/272, 263, 306, 267, 166/304, 303; 208/86

[56] References Cited

U.S. PATENT DOCUMENTS

| | | | |
|---|---|---|---|
| 2,104,327 | 1/1938 | Kotzebue | 166/306 |
| 3,302,713 | 2/1967 | Ahearn et al. | 166/275 X |
| 3,379,247 | 4/1968 | Santourian | 166/272 |
| 3,874,452 | 4/1975 | Allen et al. | 166/260 |
| 3,913,674 | 10/1975 | Krehbiel et al. | 166/270 |
| 4,007,785 | 2/1977 | Allen | 166/272 |
| 4,008,764 | 2/1977 | Allen | 166/272 |
| 4,017,383 | 4/1977 | Beavon | 208/309 |
| 4,026,358 | 5/1977 | Allen | 166/261 |
| 4,362,213 | 12/1982 | Tabor | 166/306 X |
| 4,389,302 | 6/1983 | Garwin et al. | 208/86 |
| 4,455,221 | 6/1984 | Calderon et al. | 208/347 |
| 4,514,283 | 4/1985 | Closmann | 208/86 |

*Primary Examiner*—Ramon S. Britts
*Assistant Examiner*—Roger J. Schoeppel
*Attorney, Agent, or Firm*—Dorr, Carson, Sloan & Peterson

[57] ABSTRACT

Many petroleum discoveries which have heretofore been regarded as intractable owing to the immobility of the petroleum can be economically recovered by a process involving local visbreaking of the intractable petroleum in order to produce a medium/heavy cracked gas oil which is injected into a subterranean formation of the intractable petroleum in order to recover the petroleum.

36 Claims, 3 Drawing Sheets

CONVENTIONAL REFINERY
INJECTION FLUID
BLENDING RESIDUAL FUEL
MEDIUM/ HEAVY CRACKED GAS OIL
LITE DISTILLATES
LITE CRACKED PRODUCTS LIQUID
CRACKED $C_3$ - $C_4$ (LPG)
NONCON-DENSIBLE FUEL GAS
HEAVY RESIDUAL
TO LOCAL SALES
LOCAL VISBREAKING UNIT
44

*Fig. 3*

| MATERIAL | END USE | | | | | |
|---|---|---|---|---|---|---|
| | INTERNAL USE 44 | TO PIPELINE 53 | LOCALE BLEND 72 | LOCALE SALE | RETURN TO VISBREAKER HEATER & INJECTION-66 | DIRECT INJECTION 62 |
| NONCONDENSIBLE FUEL GAS - 46 | X | X | | X | | |
| CRACKED $C_3$ - $C_4$ (LPG) - 48 | | X | | X | | |
| LITE CRACKED PRODUCTS - 50 | | X | | | | |
| LITE DISTILLATES 54 | | X | | | | |
| MEDIUM HEAVY CRACKED GAS OIL 56 | X | X | X | X | X | X |
| RESIDUUM - 68 | X | | X | X | | |
| CUTTER STOCK FROM EXTERNAL SOURCES - 61 | X | | | | X | X |

METHOD FOR RECOVERING INTRACTABLE PETROLEUM FROM SUBTERRANEAN FORMATIONS

RELATED PATENT APPLICATIONS

This patent application is a continuation-in-part of my U.S. patent application No. 410,990 filed Sept. 22, 1989 (abandoned) and likewise entitled "Method and Apparatus For Recovering Intractable Petroleum From Subterranean Formations."

BACKGROUND OF THE INVENTION

Petroleum deposits occurring in various geological structures throughout the world are principally composed of literally thousands of hydrocarbon compounds; hence petroleum products can vary greatly with respect to their chemical and physical properties. Nonetheless, virtually all petroleum produced at a profit has had one property in common—it is "liquid" at ambient temperatures. Hence it can be pumped from those subterranean formations where it is usually found.

In a few cases however, some "immobile" (solid and/or extremely viscous), and hence "intractable", petroleum deposits have been profitably recovered. Perhaps the most notable intractable petroleum deposit which has been recovered at a profit is Trinidad Lake Asphalt. This circumstance is largely due to this deposit's accessibility at the earth's surface. However, in most cases, intractable petroleum resources are located in deep subterranean formations and commercial recovery is not feasible at current petroleum prices because virtually the entire economic value of such intractable petroleum is vitiated by its high production and processing costs. Examples of such subterranean intractable petroleums are oil shale, South American Boscan crude, the La Brea Tar Pits and the heavy Santa Maria crude deposits found in extensive regions of California.

The most costly items associated with past attempts to recover such intractable, subterranean petroleum are: (1) the considerable expense of generating the enormous quantities of steam used to melt and/or reduce the viscosity of such petroleum deposits in situ, (2) the need for large volumes of expensive cutter stocks (diluents used to thin the viscosity of the petroleum produced by melting the intractable petroleum with steam), and (3) the prohibitively high costs and technical difficulties associated with conveying intractable petroleum/diluent mixtures to distant oil refineries.

In most cases conveying intractable petroleum mixtures from a well site to a refinery involves the use of pipeline systems. They are used, whenever possible, to avoid small batch costs generally associated with rail or truck transportation. However, pipelining activities with respect to intractable petroleum have produced a host of problems. Most of them follow from the fact that high pressure drops are encountered and/or high temperatures are required to pump such mixtures. Thermal expansion and, hence, leaks, odors, spills, etc. are ever present considerations. It might also be added that movement of such intractable crudes also involves significant overhead expenses which must be incurred in order to satisfy the many laws and regulations concerned with public and environmental protection. Consequently, literally billions of barrels of petroleum resources cannot be profitably recovered by currently known production methods and, for the most part, government subsidy of one kind or another is usually needed to bring such intractable petroleum to the marketplace.

Again, the most widely used methods employed by the prior art in trying to recover such intractable petroleum economically has involved the injection of steam into such subterranean formations in order to first melt the intractable petroleum. Hence, most attempts to recover such intractable crudes involve the construction of very expensive on-site steam production facilities. Typically as much as 2,000 lbs. of steam are needed to recover one barrel of petroleum from such deposits. Such steam requirements imply that the cost of the steam used to recover this already poor quality petroleum can represent as much as one-third of its economic value when it is delivered to the refinery.

The melted petroleum is then exposed to the solvent action of a thinning oil (commonly referred to as "cutter stock") so that the resulting mixture can be forced out of the petroleum formation by use of injection and recovery well systems well known to this art. Large quantities of such cutter stocks are needed to bring the melted petroleum to the earth's surface. Thereafter, even more cutter stock is needed to provide the decreased viscosity needed to pump intractable petroleum to a conventional refinery. For example, it typically takes about one-fifth to one-quarter barrel of an already refined and expensive cutter stock such as kerosine or gas oil in order to render mobile one barrel of intractable petroleum. The cutter stock must then be re-refined along with the intractable petroleum. This requirement accounts for the loss of another major fraction of the intractable petroleum's economic value.

Again, the prior art has employed many different chemical species as "cutter stocks", "injection fluids", etc. The fluids employed in the processes taught by U.S. Pat. Nos. 2,104,327; 4,007,785, and 4,514,283 are more or less representative of such cutter stocks. For example, U.S. Pat. No. 2,104,327 ("the 327 patent") teaches the use of gas oil as a cutter stock (i.e., as an injection fluid in this particular process). It should be noted, however, that for all the reasons noted in later portions of this patent disclosure, the "gas oil" taught in the 327 patent should not be regarded as being the same material as the "medium/heavy cracked gas oil" employed in applicant's process. There are many technical distinctions between gas oil and medium/heavy cracked gas oil which will be made during the course of the development of this patent disclosure; but for the present purposes of describing the state of the prior art with respect to such cutter stocks/injection fluids, suffice it to say that the gas oil disclosed in the 327 patent is a very significant, naturally occurring, constituent of "light" crude oils. It is not, however, a constituent of intractable petroleum. That is to say that gas oil is recovered at a petroleum refinery where light crude oils are normally processed. In fact, it could be said that solid (intractable) petroleum deposits are "solid" for the very reason that they lack those lighter components such as gas oil which would otherwise endow them with the liquid (tractable) characteristics which would, in turn, make them easily recoverable by conventional oil recovery methods. In any case, if gas oils are used as injection fluids to recover intractable petroleum, they would have to be hauled from the refinery to the site of the injection well. Moreover, since gas oils are "lighter fractions" of light crude oils, they would tend to be more valuable than the heavier fractions (which incidentally could, after catalytic cracking, well include medium/heavy cracked gas oils) of these same "light" crude oils.

It should also be noted in passing that, since intractable petroleum does not contain any significant amounts of gas oil, no amount of a hereinafter described process known as "visbreaking" (i.e., thermal cracking, at very low severities of cracking conditions), applied to intractable petroleum will produce gas oils. They simply are not there for such production. In other words, the only way one might get gas oils from a solid, intractable petroleum would be to catalytically crack it under those very severe conditions (high temperatures, low pressures, long residence times, in the presence of specialized catalyst, etc.) which can only be produced by full scale, oil refinery catalytic cracking units in order to break and reform the molecular structure of certain "heavy" molecules (e.g., those of asphaltenes having molecular weights up to 20,000) into much, much "lighter" molecules. Here again, such materials would have to be hauled from a refinery to an injection used to recover the intractable petroleum.

U.S. Pat. No. 4,007,785 ("the 785 patent") teaches recovery of viscous petroleum by injection of a carefully "designed", multiple-component, solvent for recovering viscous petroleum. At least one of the "designed" solvent's components is normally a gaseous material selected from the group consisting of methane, ethane, propane or butane and at least one of the solvent's components is normally a liquid such as pentane. It should be noted, however, that the solvent used in process of the 785 patent is heated and, since it is comprised in large part of lighter hydrocarbon components, it must be therefore pressurized in order to keep it in the liquid state needed to pump the fluid into an injection well.

The economics of the process taught by the 785 patent should also be taken into consideration. For example, at today's prices, the pentane component of the "designed" injection fluids taught by the 785 patent is almost twice as valuable as gasoline. These relative values also should be compared to the gas oils taught in the 327 patent—they are about comparable in value to gasoline. Even more important, however, is the fact that all of the injection fluid ingredients taught by the 785 patent and by the 327 patent are only found "at" a refinery and hence must be hauled to the site of the injection well.

The 785 patent does suggest that its solvents are so "light" they could be recovered by thermal distillation at the oil recovery site; however, the 785 patent also clearly teaches that the highest and best use of such lighter fractions in this particular process, is to use them as a carrier or cutter stock which is needed to pipe the viscous petroleum to a distant refinery. This reference states "if the viscous petroleum is to be subjected to some form of cracking in a processing unit located some distance from the production point, all or a portion of the normally liquid hydrocarbon solvent may be allowed to remain in the viscous crude to facilitate transportation thereof in a pipeline to the cracking unit. This is especially true in the instance of applying this process to tar sands, since bitumen is much too viscous to pump in its natural form."

U.S. Pat. No. 4,514,283 ("the 283 patent") teaches a process whereby viscous asphaltenic crude oils can be converted to "pumpable" liquid oil products, in field locations, by precipitating it with 100 volumes of pentane. Again pentane is an expensive ingredient—it is about twice as expensive as gasoline—whose 100 volume requirement would make for very great economic costs. Moreover, the 100 volumes of pentane would have to be hauled to the field. The process of the 283 patent also calls for (1) separation of the crude oil's asphaltene components, (2) mildly thermally converting the asphaltenes to mobile asphaltene—conversion products (by heating them to 660° F. for 1 to 3 days) and then (3) mixing the resulting asphaltene conversion products with select components of the original crude oils in order to "form a liquid oil product which can be readily pumped through pipelines."

Moreover, in addition to the costs of overcoming the technical obstacles previously noted, there also exists other non-technical, but ever present, economic dictates which permeate the petroleum industry from one end to the other That is to say the costs associated with the above noted technical difficulties reverberate through the economics of all subsequent production, transportation, refining, and marketing activities. Similar purely economic considerations also tend to discourage even the exploration which might be specifically aimed at discovering intractable petroleum resources. It should also be noted that many of the economic limitations associated with this type of petroleum follow from the simple fact that intractable petroleum, even after it is recovered, has an inherently lower economic value than lighter crudes owing to its generally heavier composition. Hence, it is inherently more expensive to refine. Overall, it yields smaller amounts of distillate products and it generally requires substantially more self-consumption of its energy value in order to carry out those subsequent operations needed to process an intractable petroleum into marketable motor fuels, heating oils, petrochemicals, etc. As a final note, it might even be said that, in many cases, a large part of the economics associated with such materials, at the oil refinery, is a reflection of the fact that a predominance of heavy, nonvolatile fractions often can bring about near distress price situations at the refinery.

In response to all of the above noted technical and/or economic problems associated with the recovery of intractable petroleum, applicant has developed processes which permit far more efficient, and hence far more economical, recovery and use of intractable petroleum. However, before going into the details of these processes, it will be helpful to define and/or comment upon certain terms used in this patent disclosure. That is to say that a number of the words and terms used to develop the scope of this patent disclosure may be employed in some special sense used in the petroleum industry, rather than in a potentially more broad sense normally associated with common English usage. Therefore, in the interest of clarity and precision, certain terms having common English meanings, as well as certain special terms, are defined in the following Glossary as an aid to understanding the ensuing portions of this patent disclosure.

GLOSSARY

API gravity: API (American Petroleum Institute) = 141.5–131.5. The resulting number, in effect, Sp.G expands the density scale to convenient whole numbers, and inverts the scale such that high API gravity corresponds to lower densities.

Catalytic ("Cat") Cracking: Cracking of the heaviest, but vaporized, petroleum fractions by use of a catalyst at severe conditions. The coke resulting from such cracking is burned to supply heat for the cracking reactions.

Coke: For the purposes of this patent disclosure, coke may be thought of as the carbonaceous residue of the destructive carbonization of petroleum. In the process of heating such materials, they may melt and evaporate at fairly low temperatures. At higher temperatures or lower volatilities a point is reached at which simple physical boiling ceases and chemical decomposition starts. The expression "coke" may also cover the material known as "petroleum coke" (see also "cracking").

Cracked Gas Oil: A portion of a synthetic crude yielded from "chemical"—as opposed to the straight-run gas oil yielded from "physical" distillation—processing of petroleum stocks and/or fractions boiling at temperatures above 500° F. and through the remaining temperature range which lies below the boiling point of any non-vaporizable residuum.

Cracking: A process in which chemical decomposition, i.e., thermal decomposition, pyrolitic decomposition, destructive distillation, is deliberately induced, but for carefully limited time durations, temperatures and at elevated pressures. Such processing creates fractions of higher volatility. Some molecular rearrangement takes place to produce less viscous, more mobile and more economically valuable petroleum products. By this same careful control of operating parameters, coke production is minimized.

Cutter Stock: A straight-run or cracked distillate petroleum product used to lighten and thin a heavy petroleum or residuum in order to lower its melting temperature and lower its viscosity and thereby render the resulting mixture more mobile and pumpable.

Distillate Fraction: A straight run or cracked distillate petroleum product which has been vaporized and recondensed. Usually this fraction is generally thought of as being heavier than kerosine, but lighter than gas oil.

Fraction: Petroleum is a mixture of virtually countless hydrocarbon compounds. Hence, it is commonly, and conveniently, divided into successive overlapping fractions which are separately defined by their circumstances of production and by certain requirements of their individual uses.

Fractionation: The distillation process required to separate petroleum into several fractions for further processing, blending, or direct sale as finished products.

Fractionator: The rectification equipment required to separate fractions.

Gas Oil: The heaviest of distillates which are normally suitable only for further processing or for use as cutter stock. In special circumstances, usually when cracked (hence there is a distinction between gas oil and "cracked" gas oil), it can be sold as a commercial, non-residual fuel, or when taken from special crudes, it can be dewaxed to yield lubricating oils. It is also the most common feed stock for catalytic cracking.

Processing: Normally the first step in processing petroleum is that of fractionating the crude petroleum at approximately atmospheric or slightly higher pressure (less than 40 PSIG) into straight-run fractions ranging from light gases to straight-run residuum. If an operation or procedure is invoked preceding this it is usually referred to as "pre-processing."

Producing: The operation of removing petroleum from its natural underground formation and bringing it to the earth's surface for processing into finished, salable products.

PSIG: Pounds per square inch gauge (pressure).

Recovering: Producing otherwise unobtainable petroleum by injecting a material into a petroleum containing formation to promote and assist in its production.

Rectification: The physical operation, equivalent to many stages of repeated simple distillations for sharply separating a mixture of materials having different boiling points.

Refractory: Use of this term implies that a petroleum product is resistant to cracking. Usually, a fraction already created by cracking is subject to further cracking only at a higher severity of conditions.

Residual Fuels: Commercial heavy fuel oil products blended from a residuum with a cutter stock to meet industrial and marine specification.

Residuum: That fraction yielded from physical rectification or cracking which never has been vaporized. It is dense, opaque, and dark brown to black in color.

Saybolt Seconds, Universal ("SSU"): SSU is a more "visualizeable", imaginable, number for viscosity than the metric unit of kinematic viscosity, centistokes. It represents the time, in seconds, for 100 cc's of material held in a vertical cylinder in a constant temperature bath to drain through a very small circular orifice in the cylinder's bottom. There is obviously a minimum time involved for even the thinnest of oils. However, where viscosity is of interest, use of this measurement produces a highly reproducible time span.

Simple Distillation: Boiling a mixture to obtain a component of lower boiling point and higher volatility. In the case of petroleum, lower boiling hydrocarbons predominate in the resulting vapor which is then recondensed apart from any remaining liquid in which a component of lower volatility predominates. The closer the two volatilities, however, the less sharp will be the separation, i.e., the more they will "overlap."

Straight Run: A fraction obtained from petroleum by physical fractionation without cracking or any chemical change.

Thermal Cracking: Cracking under relatively less severe conditions in the absence of a catalyst.

Visbreaking: Thermal cracking done, at very low severity of cracking conditions, in order to break the viscosity of a petroleum.

Other Useful Characterizations Of Petroleum Fractions

Further distinctions between some of the above terms are of great importance to a complete development of the scope of this patent disclosure. Perhaps the most important distinction to be made is between the terms "straight-run" and "cracked" with respect to their meaning as well as with respect to the physical, chemical and functional differences of the products described by these terms.

A brief discussion regarding these distinctions might begin with the observation that the history of modern petroleum refining might well be divided into two periods. The first extends from the late eighteen hundreds with the earliest production in quantity of subterranean petroleum in Western Pennsylvania, to the second period, beginning in the early 1930's, when the alteration of the chemical constituents of naturally occurring petroleum commenced. Throughout both periods, however, the natural constituents of petroleum—which can be obtained by physical fractionation without cracking—have been termed "straight-run" and this use persists to this day.

In any case, the second period in the history of petroleum refining has been characterized by a growing need to increase the proportions of the more valuable and useful products of crude petroleum. The processing procedures employed to obtain them have collectively been termed "cracking" and they consist of the application of heat and pressure over precisely controlled time periods—usually in the presence of catalysts—to promote the conversion, decomposition, rearrangement, isomerization, reformation, and synthesis of the molecules of "straight-run" petroleum into newly created "cracked" products comprised of different molecules.

Straight-run fractions fall naturally into a series of useful portions yielded from physical rectification—that is partitioning by use of successively higher temperature ranges in order to "separate" the "lighter" portions of straight-run fractions from heavier ones. Usage and longstanding convention have attached names to these fractions according to their boiling range as "light-ends", "casing-head gasoline," "naphtha (light and heavy)", "kerosine," "distillate," "gas-oil (light, heavy and vacuum)," "lube-stock," and "residuum." Moreover, in various cracking processes well known to the industry, the less desirable straight-run fractions are "recycled" for their further, chemical processing in cracking procedures and, thus, are consumed, yielding a new series of compounds covering a rather wide boiling temperature spectrum and, in effect, producing various "synthetic" petroleum ("syn-crude") products. The fractions partitioned from "syn-crude," have received some new names, viz, "light," and "heavy" "cycle oils" or "cycle stocks", but, nonetheless, custom and familiarity have caused persistence in the use of some of the old terminology employed in the practice of the older technologies.

Applicant's concern for nomenclature is, however, particularly focused on certain distinctions regarding qualifying or otherwise clarifying the use of the term "cracked gas oil" as it relates to the herein described processes. To this end, it is essential to first recognize that most commonly used petroleum industry nomenclature usually describes only boiling temperature ranges and categories of functional employment which are determined and dictated by volatility. This implies that chemically, and physically, "cracked" fractions will differ greatly from their "straight-run" counterparts. The next point to be made is that straight-run products of natural petroleum also vary, to greater or lesser extent, according to the geologic age, depth, source, etc. of the crude petroleum from which they are derived. Nevertheless, all such products contain the ratio of hydrogen to carbon associated with their organic origin. It should also be noted that straight-run products are essentially hydrogen saturated. Moreover, from a chemical structure perspective, such straight-run products have their highest hydrogen to carbon ratios in their lightest molecules. Lower hydrogen to carbon ratios are found as their molecular size increases. In general, however, the physical properties of such straight-run products are those of lighter density (increasing, albeit, with molecular weight), and higher viscosities—i.e., those of gels and crystalline solids, such as paraffin, waxes, petrolatum ("vaseline"), and asphalt. An example of this in everyday experience is seen in the easy-flowing low viscosity of polyunsaturated cooking oils, compared to the solid cooking fats, e.g., "CRISCO" ®, obtained by chemical saturation, i.e., hydrogen saturation (hydrogenation), of the very same types of oil, e.g., palm, corn, coconut, peanut, soybean oils, etc.

Therefore, recognizing that the visbreaking processes taught by this patent disclosure employ the heaviest, highest boiling, most viscous, lowest hydrogen content petroleum fractions for cracking starting materials, it follows that the resulting cracked products can only contain this lower hydrogen content over the entire boiling temperature ranges of the syn-crude. The relatively higher hydrogen contents will still naturally predominate in the smaller molecules and will decrease with increasingly heavier fractions; but the final products will, perforce, be "hydrogen unsaturated" olefinic and aromatic compounds distinctly unlike those of straight-run fractions.

These chemical differences between straight-run and cracked products are, in effect, responsible for the most salient virtues of applicant's process. The first such virtue is the drastically reduced product viscosities which are achieved by applicant's use of the mild thermal cracking procedure known as "visbreaking." Accompanying this effect is the formation of "refractory" unsaturated molecular species which are inherently stable under the temperature conditions encountered in the course of practicing applicant's process. This refractory character follows from the olefinic, aromatic, conjugated and cyclized chemical bonds of the materials produced by applicant's visbreaking process. The presence of substantial amounts of such compounds is signaled by the relatively higher density of unsaturated, cracked, molecules, compared to those of straight-run, saturated, molecules. Nevertheless, these distinctly different materials boil at the same temperatures. For example, saturated hexanes, $C_6H_{14}$ (six-carbon molecules predominating in straight-run light naphthas) have an approximate density of 5.5 lbs/gal and a specific gravity ("Sp.G." 83°API: American Petroleum Institute) of 0.66, while benzene, $C_6H_6$ (a six carbon cyclic aromatic molecule) an unsaturated, conjugated aromatic constituent of cracked, reformed light naphtha, has a density of 7.4 lbs/gal and a 0.89, Sp.G., 28°API. Applicant's main point, however, is the fact that benzene and hexanes L both boil in the same temperature range: 160°-180° F. (71°-82° C).

This markedly different relation between boiling temperature and specific gravity is often expressed in a parameter known as "U.O.P. Characterization Factor" (UOP K) which is used to correlate the performance, behavior, and characteristics of crude petroleum and its many products. UOP K can be determined by two of the simplest, quickest, and most common field laboratory tests and, in recognition of their pioneering work in this field, bears the name of Universal Oil Products Company (UOP)—perhaps the technologies associated with petroleum refining. The concepts behind UOP K Factors were originally developed in the early 1930's in the course of UOP's original researches into cracking. UOP quickly recognized—and then very elegantly fulfilled—the need to develop a fundamental index to distinguish between, and to predict the presence, quantity, and behavior of, straight-run and cracked materials. In any event, UOP K Factors are now used worldwide to interpret, explain and/or predict the chemical and physical behavior of petroleum crudes as well as the behavior of a multitude of products derived from them—be they straight-run or cracked products. This work by Universal Oil Products Company resulted in their: Universal Oil Products Company, Engineering Calculations Charts (originally issued July 14, 1936) which applicants completely incorporate by reference into this patent disclosure. The original results were, in effect, correlations made between UOP K Factors and certain calculation values which are needed for evaluation and design of manufacturing parameters, densities, molecular weights, viscosities, solvencies, hydrogen contents and so forth. These correlations largely take the form of graphs and charts. Their reproduction in subsequent authoritative references such as *Chemical Process Principles*, O. A. Hougen, K. M. Watson, and R. A. Ragatz (Second Ed) John Wiley & Sons, Inc.; Nelson, *Petroleum Refinery Engineering*, Nelson McGraw-Hill Book Company; *Physical Properties of Hydrocarbons*, Maxwell Van Nostrand, etc. serves to attest to the versatility and usefulness of the parameter, which has come to be known as "UOP K." It should also be noted in passing that since the original UOP Calculation Charts of 1936 may—because of the advent of the computer—now be out of print, the other references cited above may serve as comparable references should the UOP Calculation Charts now be difficult to obtain. The use of such charts is necessary to distinguish various materials. However, these charts are not necessary to the practice of applicant's process. Nevertheless, an example of one particular "UOP K comparison" will be given in the "Preferred Embodiments" section of this patent disclosure for the very special purpose of bringing out and contrasting the meaning of the volatility characteristics (boiling ranges) that would result from the use of certain specific chemical cracking processes wherein vastly different densities result for certain petroleum products (straight-run virgin gas oil vs. cracked recycle gas oil) having similar volatilities. That is to say that this special case will be developed to compare, on the basis of UOP K Factor differences, a typical "gas oil" derived directly from straight-run fractionation with a "cracked" analogue of a gas oil having the same boiling range, but having a markedly higher density due to the changed nature of its chemical constituents and especially due to its much lower hydrogen to carbon ratio.

In any event, UOP K Factors for these materials may—if needed—be used to predict the results of changes in temperature, pressure and process times in petroleum refining operations involving these particular materials. Such UOP K Factors could also serve to distinguish the nature of chemical bonds present, and thus serves to further distinguish between straight-run and cracked stocks. In connection with this comparison, applicant also will incorporate select technical information taken from various UOP charts pertaining to certain inspection results directly tied to the UOP K Factors employed. These details will however be more or less confined to the Description Of The Preferred Embodiments section of this patent disclosure.

For the most general purposes of this patent disclosure, however, it will suffice to merely be aware that the UOP K values used to characterize the products obtained from applicant's visbreaking operations may be regarded as the hallmarks of certain underlying, more precise, descriptions which come into play as part of the successful practice of applicant's process. That is to say that the UOP K Factor, in effect, gives a description of an overall product's distribution of product components, its stability at certain temperatures, its high aromatic solvency, its drastically reduced viscosity and its yield of heavy black fuel oil, etc. Moreover, these comments with respect to Universal Oil Products K Factors (UOP K Factors) are important to the development and scope of this patent disclosure because—owing to the precision associated with them—they are used as limitations upon the scope of the claims of this patent disclosure.

For now, however, it need only be appreciated that the U.O.P. characterization factor K of a given hydrocarbon is defined as the cube root of its absolute boiling point in degrees Rankine divided by its specific gravity at 60° F. and that this ratio is indicative of the general origin and chemical nature of a given petroleum product. For example, values of 12.5 or higher indicate a material predominantly paraffinic in nature. By way of further clarification, Table I lists Pennsylvania, Midcontinent, and Gulf Coasts stocks having higher UOP K values than all the others which refer to cracked, "recycle" materials. The high values of the localized "stocks" refer to crude petroleum and those straight-run, "virgin" products obtained from its physical fractionization. The term "virgin", for the purposes of this patent disclosure can be taken to mean "unchanged" in chemical composition from the results of geologic aging after eons of time. On the other hand, highly aromatic materials have characterization factors of 10 or less. Some typical UOP K factor values for certain petroleum materials are as indicated in Table I.

TABLE I

| Petroleum Products | UOP K Factors |
|---|---|
| Pennsylvania Stocks | 12.0–12.4 |
| Midcontinent Stocks | 11.8–11.9 |
| Gulf Coast Stocks | 11.0–11.5 |
| Cracked Gasolines | 11.4–12.0 |
| Combined Feeds | 10.5–11.4 |
| *Recycle Stocks | 10.0–10.8 |
| Cracked Residuums | 10.0–11.0 |

*It should be particularly noted at this point that the term, "recycle stocks" is the refiner's nomenclature for an identical material also commonly referred to as "medium to heavy cracked gas oil." Thus, applicant's use of the term "medium/heavy cracked gas oil" should be taken to include the terms "recycle stocks" and "medium to heavy cracked gas oil". Again the materials-and hence the terms used to describe them-should be regarded as being synonymous because they all have UOP K Factors in the range from about 10.0 to about 10.8. Thus, when applicant uses the term "medium/heavy cracked gas oil," it should be understood that this is just another way to describe a recycle stock having a UOP K between about 10.0 and about 10.8. Note also that any overlapping values are not for comparison of stocks in the same boiling ranges. As previously noted, applicant has chosen the "recycle stock" UOP K range of 10.0 to 10.8 not only because of the familiarity of the subject material to the industry, but also to: (a) fix the volatility relationship that exists between the "straight-run gas oil" product of crude fractionation and its analog the "cracked gas oil" product of the later fractionation of the synthetic crude produced by cracking processes and (b) fix this patent disclosure's definition of the term "medium/heavy cracked gas oil and (e) fix the scope of the applicant's patent claims.

SUMMARY OF THE INVENTION

An initial understanding of the special utility of applicant's invention can be gained by first focusing on a brief description of a petroleum refining apparatus called a "visbreaker" and the technical consequences of that refining procedure, "visbreaking", which is carried out in it. Such focusing also will serve to explain why applicant's "unorthodox" employment of visbreaking eliminates most of the technical problems encountered in the use of prior art methods of recovering intractable petroleum, and why applicant's process also simultaneously provides a whole array of distinctive economic and environmental benefits. To this end, three initial points should be borne in mind:

1. Visbreaking is a chemical procedure in which a petroleum feedstock undergoes destructive distillation (pyrolytic decomposition) under mild, carefully controlled and limited conditions of temperature (higher temperatures increase severity), pressure (higher pressures reduce severity), and time (longer times increase severity).
2. Visbreaking is ideally suited for breaking down "heavy", highly viscous hydrocarbons of the largest molecular sizes because they are the only sizes for which mild conditions of temperature and pressure can be precisely controlled to produce a wide spectrum of synthesized, rearranged, and smaller hydrocarbons in those ranges of volatilities and viscosities most suitable for convenient conventional uses, and yet which can be halted before carbonizing to coke takes place.
3. Visbreaking operations have heretofore always been carried out in petroleum refineries as the last refining operation in the many successive procedures followed in processing lighter petroleum feedstocks. That is to say that lighter, mobile crude petroleum types leave a non-volatile residue even after undergoing fractionation under high vacuum. Such residues have unusually high density, molecular weight, and viscosity; hence, such characteristics would lead to an unacceptable decomposition of such residues to large quantities of coke (solid carbon residue of organic decomposition) if such residues were subjected to other refining procedures. Thus, it could be said that, to some large degree, applicant's invention is based upon an appreciation that to some extent heavy intractable crudes are similar to the residue products of conventional crudes and that it could be made advantageous to apply visbreaking to such intractable crudes. However, it should also be especially noted that applicant's application of visbreaking takes place at the well site, rather than at the refinery.

Having made the above points about the prior uses of visbreaking in the petroleum industry, applicant would again point out that the essential features common to almost all currently employed methods of recovering such intractable petroleum deposits do not include visbreaking; rather they generally revolve around:

1. The injection of high pressure, saturated steam into an intractable petroleum formation in order to release heat and pressure and thereby improve mobility and force such petroleum to the earth's surface. Such steam is, however, very expensive—indeed the costs of capital equipment, labor, fuel, chemicals, boiler feedwater preparation, etc. have driven many such recovery operations to the point where they simply cannot be justified from the point of view of overall economics. As previously noted, the steam employed for such purposes is usually required in quantities of about 3-5 barrels of steam per barrel of recovered oil. Such steam is therefore provided at a cost of some $6 per barrel at current fuel prices. Moreover, from a purely technical point of view, as opposed to the previously noted economic considerations, steam provides a relatively limited temperature at saturation—perhaps 500° F. at 680 pounds pressure.
2. The use of injection fluids other than steam, particularly light crude petroleum fractions in order to dissolve the intractable petroleum. Such light crude petroleum fractions (e.g., gas oils—that is to say straight-run fractions, as opposed to cracked gas oil) pentanes, kerosine, etc., are usually injected at ambient temperature in order to improve the "mobility" of the petroleum contained therein. Such fluids have also been used for subsequent blending at the surface in order to render such crudes less viscous and hence more easily transported to a refinery. Such light crude fractions cannot, however, serve as a very good heating medium for a subterranean heavy petroleum because at relatively low temperatures (i.e., low relative to those of applicant'injection fluid) they will evaporate. Moreover, at the higher pressure and temperature conditions contemplated in applicant's technology, light distillates such as those noted above are subject to thermal decomposition. They also present serious safety hazards, especially if they do become volatilized. Furthermore, the price per barrel to purchase such light distillates for use as diluents is often several times the worth per barrel of crude recovered. Consequently, those transport processes (piping, trucking, etc.) which typically require about 20% diluent in order to prevent the intractable petroleum from re-solidifying, become very costly; indeed these costs often approach the value of the crude itself. To make this picture even bleaker, a refinery will only pay back a crude oil price for such diluents and charge a fee for its re-refining to boot.
3. Transportation of the entire volume of warm, heavy black crude to a distant refinery. Aside from costs, such transportation implies a constant threat to the environment in the form of odors, spills, traffic hazards and the like.

Thus having pointed out some of the more important drawbacks to current methods of recovering intractable petroleum, it now remains for the applicant to fully describe the effects of visbreaking on intractable petroleum and how applicant's process provides a unique set of solutions to the above noted problems. However, before going on to this aspect of applicant's invention, it should at least be noted in passing that steam injection, dilution, fractionation and rectification—indeed, all current approaches to recovery of intractable petroleum—are "physical" operations such that if one puts all their products back together, one has precisely the same things one started with. Again, this is why such petroleum must be diluted and/or heated in order to be transported without resolidifying. Visbreaking on the other hand is a "chemical" procedure involving many chemical reactions such that the starting materials are irrevocably changed. That is to say that the original intractable petroleum can never be restored no matter how recombined. Thus, the visbreaking reactions of applicant's technology produce moderate thermal decomposition which serves to change the essentially saturated and cyclic heavy hydrocarbons of crude petroleum into a complete range of smaller, unsaturated and aromatic molecules. In other words, the products of applicant's visbreaking operations are rendered as "refractory" materials. That is, they have already been "cracked" and hence are not subject to further decomposition—unless subjected to conditions of higher severity than those pressures (e.g., 400 psi) and temperatures (e.g., up to 900° F.) at which they are produced. This means that the middle distillates and mobile residual products resulting from applicant's visbreaking operations can be injected into a subterranean formation at far higher temperatures than those temperatures which can be attained by the injection of steam and/or by light fractions such as pentane, kerosine, and gas oil (i.e., straight "virgin" gas oil).

The various products which result from applicant's vis-breaking of intractable petroleum cover the gamut of volatilities from hydrogen and light hydrocarbon gases, through cracked high octane naphthas for gasoline blending, middle distillates for light and medium fuel oils (or for catalytic cracking), to a new lower viscosity black residuum. This residuum can be blended locally at the visbreaker with its own products distillates in order to make finished industrial fuel oil which is quite suitable for immediate local sale; hence the residuum need not be transported to a distant refinery. The net result of the herein disclosed visbreaking process is that only about 40% of the heavy crude, in the form of clean net distillate liquids, need be transported to a refinery. Moreover, the distillate liquids can be transported at ambient temperatures thereby eliminating any need to: (a) purchase diluents, (b) transport the remaining 60% of the products, (c) heat during transport and (d) comply with a host of regulations aimed at minimizing the dangers associated with odors, spills, explosions, traffic, etc. Moreover, the distillate liquids which are, in fact, transported from applicant's intractable petroleum production sites can be handled, processed and blended at a refinery much more simply than even lighter crudes and, consequently, command even higher prices than those of light crudes.

It should be noted that applicant's visbreaking process at the wellhead also results in a liquid volume gain of about 4–5%, i.e., a volume gain to 104–105% of the original volume of the heavy crude upon its recovery. Thus, since petroleum products are marketed by volume, all fuel gas, plus any residual fuel used to fuel the visbreaking operation, being less than this 4–5% gain, is, in effect, obtained at zero net cost. That is to say the fuel needed to fire the visbreaker is obtained, in effect, free of charge from the intractable petroleum being recovered. Hence, the visbreaker's fuel does not have to be purchased from outside sources or hauled to the well site. As an added note, hydrogen, light olefinic and isomerized gases, and LPG are yielded for petrochemicals, polymerization, alkylation, desulfurization, etc. if they are locally desired. And, as an added advantage, electricity easily could be made a distinct adjunct feature of applicant's process—even cogenerated—in areas where electricity can be placed in existing electrical distribution networks.

Next, it should be noted that—since it is a high temperature liquid—the medium/heavy cracked gas oil injection fluid generated by applicant's visbreaking operations (i.e., the cracked gas oil produced by the visbreaker in the range of about 400° to 1,000° F.) can be efficiently pumped, at high pressure, back into the subterranean formation. Furthermore, because these injection fluids are liquids (as opposed to steam or gas oil or pentane or kerosine) at the temperatures (400°–900° F.) employed by applicant's process, they will exert up to 0.5 psi of hydraulic head for every foot of formation depth. Consequently, the higher mass and temperature of applicant's liquid injection fluid will convey and transfer vastly more heat to the formation and at much higher pressures than those obtained by steam and in any case, without the ruinous expenses (up to $6/Bbl of petroleum recovered) associated with steam generation. Furthermore, the aromatic solvent nature of applicant's medium/heavy cracked gas oil injection fluids also enables applicant's injection fluids to act as a thinner and diluent for the intractable crude.

Finally, it should also be pointed out that, at the temperatures employed by the processes of this patent disclosure (e.g., up to about 900° F.), some of the ground waters normally found beneath and/or mixed with many intractable petroleum deposits will be converted to high pressure steam (and thereby produce pressures up to 3,000 psi) right in the formation, and thus serve to strip the formation of oil at increasing rates as the formation becomes hotter and the material thinner; and later on, when the well is finally nearly ready to be abandoned, any oil remaining will have been rendered more mobile and recoverable by use of applicant's process and, hence, more susceptible to conventional water flooding and/or pumping procedures. Thus applicant's on-site visbreaking approach to recovering intractable petroleum will profitably recover heretofore uneconomic deposits of intractable petroleum while eliminating a whole host of potential safety and environmental hazards implicit in all methods heretofore employed to recover intractable petroleum. This invention also provides a key toward making possible a new petroleum industry approach to dealing with such heavy crudes, i.e., a new attitude toward their economics, handling, and employment. Again, this new approach starts with pre-processing intractable crudes on a "local" basis, that is, in the general vicinity (say within 10 miles of a production well used to bring the intractable petroleum to the earth's surface) of where they are recovered.

The herein disclosed methods start with the use of an "imported" or "start-up" injection fluid to get the process going. The injection of this imported injection fluid is followed by the use of visbreaking as a "local" refining step in order to convert large portions of such intractable petroleum to a range of locally saleable products and thereby eliminate the technical and economic problems otherwise associated with transporting them to a full scale refinery. This local approach to recovering intractable petroleum may also be based upon on-site pre-processing of the intractable petroleum recovered by a light to moderate form of thermal cracking known as "visbreaking"—that is this process provides a "local" breaking of viscosity and chemical re-formation of an intractable petroleum by controlled pyrolitic decomposition of some of its organic materials, generally in the absence of catalysts, in order to break apart the largest molecules comprising the material and/or to rearrange some molecular structures in order to yield a moderate portion of lighter volatile products from a heavy intractable petroleum feed stock. One of the lighter volatile products of such visbreaking—namely medium/heavy cracked gas oil—and especially medium/heavy cracked gas oil recovered from the visbreaker between about 400° F. and about 1,000° F. and having a UOP K Factor in the range of 10.0 to 10.8—is particularly suited as an injection fluid in an injection and recovery system hereinafter more fully described. For the purposes of this patent disclosure visbreaking also should be thought of as a means of reducing the melting point and viscosity of the heaviest portions of the intractable petroleum material for blending and direct local sale or for preparing certain portions so they can be piped or otherwise handled at only slightly elevated temperatures (e.g., 200° F.) and moderate pressures (e.g., less than 500 pounds per square inch gauge, "PSIG") and hence, rendered capable of being handled at greatly reduced costs.

Again, applicant's process generally begins by using a relatively small amount of a "start-up" injection fluid such as those used as the "primary" injection fluid in the prior art processes previously described. That is to say that kerosine, pentane, "gas oil" (all of which, in most cases, will be purchased from outside sources and shipped to applicant's "local" recovery site), etc. will be used to recover an "initial portion" of intractable petroleum. This initial portion of intractable petroleum is then subjected to a visbreaking action in order to produce a spectrum of petroleum products which will include a medium to heavy ("medium/heavy") cracked (and therefore refractory) gas oil which, upon accumulation, is then injected, in the form of a very hot liquid, into the subterranean formation in order to recover subsequent portions of the intractable petroleum material and to diffuse heat through said formation. It should also be noted, however, that the "start-up" injection fluid may well be, and in many cases will most preferably be, a medium/heavy cracked gas oil product taken from another visbreaker unit which may be operating in the general vicinity of the visbreaking being started. That is to say that the medium/heavy cracked gas oil product of a first visbreaker unit (e.g., such as another visbreaking unit carrying out applicant's process in the same intractable petroleum formation) may be used as the "start-up" injection fluid for a second visbreaker unit. Again, for the purposes of this patent disclosure, the visbreaker employing applicant's method at any given point in this patent disclosure (e.g., in the patent claims) may be referred to as the "local" visbreaking unit. In any case, local visbreaking of the intractable petroleum recovered by the start-up injection fluid will produce greater and greater quantities of the medium/heavy cracked gas oil which can then be recycled, in ever increasing quantities until it eventually meets a large part (or all) of the injection needs of the local injection well/recovery well system used to recover the intractable petroleum from its subterranean formation.

However, it should be noted that in some preferred embodiments of this method the medium/heavy cracked gas oil can be supplemented by other fluids such as compressed air, hot water and/or utility steam. Preferably such supplemental materials (compressed air, hot water and utility steam, etc.) can be injected in the form of separate, discrete slugs of said materials. However, such supplemental materials also can be mixed (preferably at the point of injection) with the medium/heavy cracked gas oil injection fluid and/or mixed with each other before, or simultaneously with, mixing with the medium/heavy cracked gas oil.

In any case, the medium/heavy cracked gas oil acts as a medium to carry heat to the intractable petroleum in order to melt it. It also acts as a "thinner" for the intractable petroleum once it is so melted. Thus, the overall heating, melting and thinning action renders the intractable petroleum mobile and pumpable and hence suitable for recovery at the earth's surface via a system of injection and recovery wells. As an accumulation of this medium/heavy cracked gas oil becomes large enough to meet the requirements of the injection well/production well system, any surpluses may then be used for other purposes such as, for example, use as a "cutter stock" for blending thermally cracked residual products to a wide range of industrial specifications. That is to say such materials may be used to make various grades of heavy industrial and/or marine fuels which need no further processing and hence which are immediately saleable locally as they are produced by the visbreaking unit.

Stated in more detail, this method for producing petroleum from a subterranean formation of intractable petroleum, generally comprises: (1) constructing and operating a local visbreaking unit above a subterranean formation of intractable (immobile) petroleum; (2) starting production of petroleum from the subterranean formation by: (a) injecting a "start-up" injection fluid obtained from a source other than petroleum production from the "local" visbreaking unit, (b) obtaining an initial portion of petroleum from the subterranean formation and (c) introducing the initial portion of the petroleum from the subterranean formation into a local visbreaking unit; (3) vis-breaking an initial portion of the intractable petroleum recovered from the subterranean formation in order to obtain a first portion of that medium/heavy cracked gas oil produced by the visbreaking unit in a temperature range from about 400° F. to about 1,000° F. at moderate pressures (e.g., from about 200 PSIG to about 800 PSIG) and having a UOP K between about 10.0 and about 10.8; (4) injecting, in the form of a hot liquid, by means of an injection well penetrating said subterranean formation, all or at least a part of the first portion of medium/heavy cracked gas oil into the subterranean formation in order to impinge upon, melt and mix with a subsequent portion of the intractable petroleum and thereby form a resulting hot, mobile, mixture of medium/heavy cracked gas oil and melted, and hence "tractable," petroleum; (5) recovering the resulting hot, mobile, mixture of medium/heavy cracked gas oil and melted petroleum; (6) introducing the resulting hot, mobile, mixture of medium/heavy cracked gas oil and melted petroleum into the visbreaking unit in order to obtain a second portion of medium/heavy cracked gas oil having a UOP K factor between about 10.0 and about 10.8; (7) injecting at least a part of the second portion of medium/heavy cracked gas oil into the subterranean formation in order to melt and recover subsequent portions of the intractable petroleum. Optionally, after an extended period during which the hot cracked cutter stock (which is, preferably, the medium/heavy cracked gas oil having a UOP K factor between about 10.0 and about 10.8) has heated and permeated the subterranean porous structure, it can possibly be supplemented with—or even replaced by—another cheaper motive fluid such as compressed air, hot water, and/or low quality utility steam.

In most cases the resulting hot, mobile, mixture of medium/heavy cracked gas oil and melted petroleum will be initially recovered from the injection well into which the medium/heavy cracked gas oil is pumped. Thus a single well could serve as both the injection well and the recovery well. However, in some of the more preferred embodiments of this invention, the resulting, hot mobile mixture will eventually be placed in fluid communication with one or more recovery wells through which said resulting, hot mobile mixtures are recovered. The nature of the intractable crude with respect to the permeability of the formation, hydrocarbon content, etc. will generally determine the distances such production wells can be offset from the injection well or injection wells. This invention is also intended to apply in the context of simultaneous recovery from more than one production well singly or multiply driven by one or more injection wells. It also contemplates that the term "drilling" will also mean the use of existing wells (e.g., those presently used for injecting steam into such subterranean formations) as injection and/or recovery wells for the overall practice of this invention.

Preferably, the medium/heavy cracked gas oil produced by the local visbreaking unit is injected into the injection well at temperatures ranging from about 400° F. to about 1000° F. and at pressures ranging from about 100 PSIG to about 2,000 PSIG. This is most conveniently done via an injection well comprised of an injection pipe centrally positioned in a casing pipe having a larger diameter. This piping arrangement conveniently defines an annulus through which the resulting hot, mobile, mixture can be readily recovered.

In addition to manufacturing a medium/heavy cracked gas oil fraction having a UOP K Factor between about 10.0 and about 10.8 and which is injected, as a liquid, into the injection well, operation of the visbreaking unit also may yield many other products which may include, but not be limited to: (1) a noncondensible fuel gas which is used to fuel the visbreaking unit, (2) noncondensible fuel gas in quantities sufficient not only to meet the fuel requirements of the visbreaking unit itself, but also to provide a noncondensible fuel gas product for local sale and/or for use in cleansing other distillate products yielded from the visbreaker, (3) cracked naphtha which may be transferred to a conventional refining facility for further processing and incorporation into commercial motor fuels, (4) light cracked intermediate distillate products which are transferred to a complete refining facility for further processing and incorporation into other fuel products, (5) medium/-heavy cracked gas oil having a UOP K Factor between about 10.0 and about 10.8, produced in excess of injection requirements, which is locally blended with heavy cracked residual products of the visbreaking operation in order to make a heavy residual industrial fuel, (6) medium/heavy cracked gas oil having a UOP K Factor between about 10.0 and about 10.8, produced in excess of injection requirements, which is transported to a complete refining facility for further processing and sale, (7) saturated and unsaturated $C_3$ and $C_4$ hydrocarbons which may be sold locally as a liquified petroleum gas ("LPG") product, (8) saturated and unsaturated $C_3$ and $C_4$ hydrocarbon products which are transported to a complete refining facility for further processing and sale and (9) cracked residuum. This patent disclosure also contemplates operation of the visbreaking unit to yield petroleum products whose sensible heats, as well as whose convection and radiant heats produced by local visbreaking operations (e.g., in its local cracking furnace), are employed to produce steam locally for utility purposes and/or sale, and/or to preheat cold cutter stocks for injection, or otherwise used to provide a saturated or superheated working fluid for production of electric power for internal consumption and/or for local sale).

Once more, the methods of this patent disclosure also contemplate some specific methods or procedures for "starting-up" the herein disclosed methods in order to get to a stage where substantially steady-state operations prevail. One particularly preferred start-up method comprises: (1) constructing and operating a local visbreaking unit above the subterranean formation; (2) drilling and completing an injection well to the subterranean formation of intractable petroleum (such drilling may be the drilling of a new well hole or use of an older well previously used for other purposes); (3) introducing a smaller concentric pipe into the well to define an annular space between the outside of the smaller concentric pipe and the inside of the well through which fluids can rise in the well; (4) preheating the injection well by flooding its annular space with a mobile, injection fluid, preferably one preheated in a coil of the visbreaking unit's furnace; (5) starting production of petroleum from the subterranean formation by: (a) injecting a start-up injection fluid obtained from a source other than petroleum production from the local visbreaking unit, (b) obtaining an initial portion of petroleum from the subterranean formation and (c) introducing the initial portion of the petroleum from the subterranean formation into the local visbreaking unit; (6) injecting a hot, mobile, injection fluid (which may be the same species of fluid used to heat the annular space or a different species of fluid) into the smaller concentric pipe in order to impinge said injection fluid upon an exposed surface of the intractable petroleum formation and thereby forming a resulting hot, mobile, mixture of injection fluid and melted petroleum; (7) recovering the resulting hot, mobile, mixture of injection fluid and melted petroleum by continuous injection of the injection fluid into the smaller concentric pipe and continuous recovery of the resulting hot, mobile mixture of injection fluid and melted petroleum through the annular space; (8) progressively lowering the smaller concentric pipe in the well in order to attack progressively more distant regions of the intractable petroleum and hence progressively increasing the volume of the porous subterranean structure exposed to the resulting hot, mobile, mixture of injection fluid and melted petroleum; (9) introducing the resulting hot, mobile, mixture of injection fluid and melted petroleum recovered through the annulus of the injection well into the visbreaking unit; (10) visbreaking the resulting hot, mobile, mixture of injection fluid and melted petroleum in order to produce additional medium/heavy cracked gas oil; and (11) injecting at least a portion of the medium/-heavy cracked gas oil into the smaller concentric pipe in order to melt and recover subsequent portions of the intractable petroleum.

Any suitable injection fluid known to the art can be employed in starting or initiating this method of recovery. Fluid hydrocarbons are however generally preferred for such start-up operations. That is to say that these start-up methods specifically contemplate the use of various hot, mobile injection fluids (in addition to the preferred fluid— medium/heavy cracked gas oil) to "start-up" the process. These other fluids might include, but not be limited to: (1) hydrocarbon fluids, especially those having substantially the same volatility as medium/heavy cracked gas oil, (2) hydrocarbon materials which are liquid at temperatures ranging from about 400° F. to about 1000° F. at pressures of from about 100 PSIG to about 2000 PSIG and which may also be capable of at least partially thinning the intractable petroleum under said temperature and pressure conditions, (3) a medium/heavy cracked gas oil produced by a petroleum refinery unit other than the local visbreaking unit, (4) a medium/heavy cracked gas oil produced by a petroleum refinery unit other than the local visbreaking unit and which is heated to a temperature ranging from about 400° F. to about 1000° F. and injected into the injection well at pressures ranging from about 100 PSIG to about 2,000 PSIG and (5) mixtures (in all proportions) of all such hot, mobile injection fluids.

Again, it will usually be the case that the hot, mobile injection fluid will also be a medium/heavy cracked gas oil of the type produced by the visbreaking unit. However, an initial amount of such an injection fluid might have to be brought to the local visbreaking unit from outside sources (e.g., from a conventional oil refinery) to commence the start-up procedures. This material can be heated in the visbreaking furnace (e.g., to 400°-1000° F.) just prior to injection. When fluids other than medium/heavy cracked gas oil are initially employed, they can be, and preferably are, replaced with medium/-heavy cracked gas oil as more and more of it is produced by the visbreaking unit. That is to say, in the most preferred embodiments of this invention, the medium/-heavy cracked gas oil produced by the visbreaker will eventually become the preferred, the predominant, if not the only, hot hydrocarbon fluid which is injected into the subterranean formation. However, at later stages in the useful life of the formation, other fluids such as hot water, steam, compressed air and the like may also be employed as injection fluids. Mixtures of medium/heavy cracked gas oil and residuum products of the visbreaking operation may also be employed to advantage in such later stages of operation.

This recovery method also could involve filling a production well before it is in fluid communication with the injection well, with a mobile fluid (preferably one that has not been heated) and observing the production well's wellhead pressure and/or temperature in order to determine when the resulting hot, mobile, mixture of injection fluid and melted petroleum comes into fluid communication with the recovery well. Such temperature and/or pressure changes could be used to indicate when the hot, mobile injection fluid initially used can be partially or fully replaced with another injection fluid which, in many preferred cases, may have a volatility lower than that of the original injection fluid. This start-up method (as well as subsequent steady-state operations) also contemplate the use of means such as caps or nozzles, or horizontal drilling, for directing the hot, mobile injection fluid toward an offset, recovery well (or wells) which penetrates the subterranean formation.

DESCRIPTION OF THE DRAWINGS

FIG. 1 also shows the associated wells and subterranean structure in cut-away view.

FIG. 3 is a matrix of possible end uses of some of the more important products of the visbreaking operations of this patent disclosure.

DESCRIPTION OF THE PREFERRED EMBODIMENTS

Figure 1:
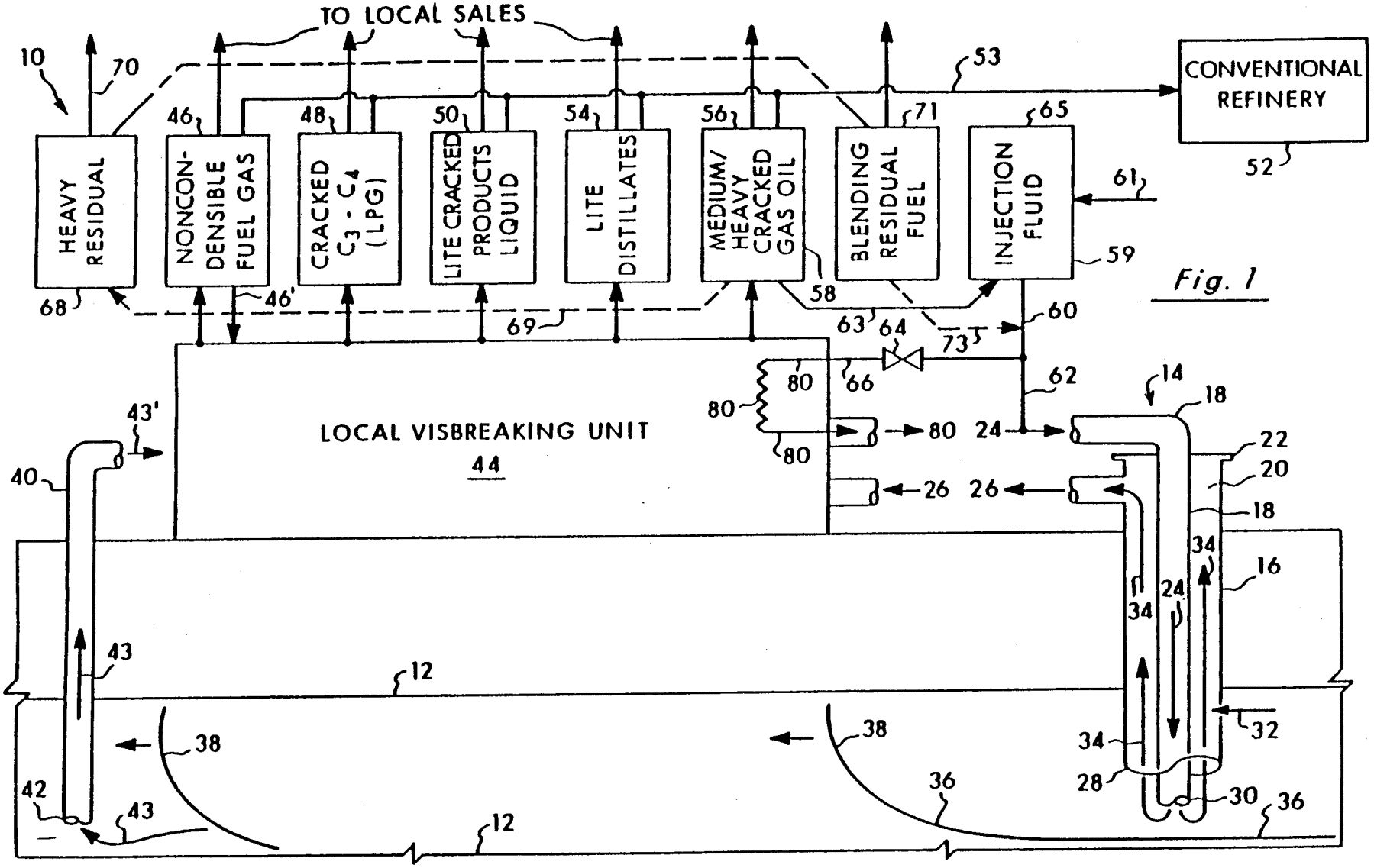
FIG. 1 is a modular depiction of the visbreaking unit located above, and operating upon, a subterranean formation of intractable petroleum.

The first part of this "Description of the Preferred Embodiments" section will be devoted to a presentation of a reasonable example designed and intended to demonstrate the powerful effects of visbreaking on product properties as signaled by the apparently innocuous small differences in values of the powerful and vitally important parameter, UOP Characterization Factor (UOP K). Thereafter, a detailed description of a representative, on-site, visbreaking operation—including an injection and recovery system—will be given according to the more preferred teachings of this patent disclosure.

UOP K FACTORS

A better appreciation of applicant's process can begin by noting that UOP K by definition links three simple numbers together in such a way that density and boiling point as related by UOP K serve to provide a sensitive insight into the chemical bonding structures of petroleum hydrocarbons. It is important to note that any two of these numbers may be used to determine the third. Thereafter, a whole gamut of physico-chemical properties becomes available in many, strikingly accurate correlations, not to mention prediction of processing results. It should also be noted that, by way of further clarification, if the general origin and nature of a stock is known, its UOP characterization factor may be roughly estimated from certain UOP tables such as those found in the previously noted reference: Engineering Calculation Charts, Universal Oil Products Company (July 14, 1936).

Other charts found in references such as this permit determination of a characterization factor from A.P.I. gravity and measurements of viscosity at 210°, 122°, or 100° F. respectively. The gravity and viscosity locate the point representing the stock on the proper chart. The characterization factor and cubic average boiling point may be estimated by interpolating between the curves. Viscosity conversion factors are also given. Thus, by means of such charts it is possible to estimate the cubic average boiling point without the necessity of actual distillation. However, in order to obtain the other average boiling points described it is necessary to assume a so-called Engler slope in order to establish the corrections obtained from other charts. It should also be noted that UOP characterization factors are best determined from viscosity measurements at the highest possible temperature.

In order to show the potential usefulness of UOP K Factors, and particularly as they relate to certain aspects of this patent disclosure, two typical stocks of identical boiling ranges are given, namely that of a straight-run "virgin" gas oil (i.e., physically separated natural fraction of crude petroleum) boiling from 650° to 1050° F. (as corrected for pressure), vis-a-vis that of a cracked "recycle" gas oil (i.e., fraction of a synthetic crude produced by chemically cracking a virgin material "recycled" for secondary processing) having the same boiling range. Again, the "recycle" gas oil discussed in Table I is identical to applicant's "medium/-heavy cracked gas oil".

Such a straight-run gas oil might be obtained as the heaviest distillate fraction of a typical mixed-base crude. This fraction is normally catalytically cracked (formerly thermally or "Dubbs" cracked) to a full boiling range synthetic crude. On occasion, this material can also be "dewaxed" to yield, at best, a rather mediocre lubricating oil. The particular straight-run gas oil used in comparison depicted by Table II was deliberately chosen in order to avoid prejudicing the comparison by using an "extreme" example such as gas oil yielded by a Pennsylvania paraffin-base crude. The material with which this straight-run virgin gas oil is compared is representative of the cracked gas oil which will be produced by the visbreaking process called for in this patent disclosure. It should be noted that it has excellent solvent properties and it melts to a very mobile liquid consistency: starting from a virtual solid at ambient temperature, it becomes a liquid of diesel fuel mobility at 200° F., it has one-third the viscosity of water at 500° F. and it has an unmeasurably low viscosity at 900° F.; hence it is an excellent comparative example. Moreover, this material is produced at 925° F. and will not crack unless heated to higher temperatures. At 500° F., due to its solvent aromaticity it also will dissolve mutually with water. As previously noted, all of these characteristics will aid in the recovery of intractable petroleum materials. By way of contrast, the straight-run gas oil which applicant has employed for the sake of comparison has a very low aromaticity, will not dissolve with water, will decompose at 750° F., and, thus, must be distilled under vacuum. Finally, the straight-run product has the lubricating property, at least to a moderate degree, of changing viscosity only slowly with temperature. Again, the cracked "recycle" material changes viscosity very rapidly with temperature—going from virtually a solid at ambient temperature to a consistency comparable to that of liquid butane at 500° F..

The UOP Calculation Charts reference also contains the predicted results of laboratory inspection (testing a petroleum product's suitability with respect to its applications) performed according to the test methods developed by the American Society For Testing Materials. These are convenient, empirical, tests made under carefully prescribed conditions as quicker, easier, and cheaper than any attempts to evaluate true intrinsic physical properties.

In virtually all cases the charts present abscissa values in graphs corresponding to ordinate values—one or more scales—according to values interpolated from a family of lines plotted as parametric values—also one or more sets—each pertaining to an ordinate scale. Again, in all cases any pair of the three: abscissa, parameter, and ordinate, may be used to obtain a value of the third. If this is taken as a general procedure, the use of these calculation charts is readily apparent.

Applicant has prepared Table II in a prescribed order: the sequence of values that would be successively developed through the use of the UOP Calculation Charts. As each value is obtained from the original data a picture evolves with each new piece of "derived" information.

In this example, for illustration purposes, applicant's primary data consists of two materials both named "gas oil" of identical boiling range, but differing in the sources from which they were obtained. One is straight-run "virgin" material and the other is a cracked "recycle" stock. Applicants have postulated as their distinguishing characteristics, a typical value of the UOP K for each.

All other information and numbers shown in Table 2 follow directly from the UOP calculation charts in direct consequence of these two single assumptions: (1) the assumption of an identical boiling range and (2) the postulation of different UOP K's chosen as "typical" for the distinction we wish to make. The tabulations serve as a guide for those wishing actually to follow these calculations through the charts. To this end, the particular UOP calculation chart used to obtain each piece of information (with the exception of arithmetical results), has been tabulated in the first column of Table II.

The values tabulated in Table II, Example of Gas Oils Comparison, show representative, comparative, values for straight-run, "virgin", gas oil and for cracked "recycle" gas oil. The table was developed by referring to the references, directions, descriptions and illustrations accompanying the appropriate text graphs in the UOP Calculation Charts.

The effects of the difference in UOP K values for these two materials start to become apparent in the API gravity and density figures. They become more pronounced as the chemical composition: weight percent hydrogen, the nominal chemical formula and thence the hydrogen to carbon atomic ratio (H/C) emerge. That is to say that the average molecules in the process of cracking go only from 30 to 24.4 carbons. However, virtually half of the hydrogen atoms are stripped—no doubt appearing in the cracked gasoline gases.

Differences directly affecting utility become apparent in the relative viscosities. Note for example that at 100° F. the cracked material is a very viscous liquid but at 210° F. it is almost as thin as straight-run which thinned relatively much less. At 500° F. the recycle stock has less than half the viscosity.

Significance of the boiling point lies in that is is actually the temperature in °F. at which, upon cooling from high temperature, a standard clear solution of the chemical aniline with the test material begins to cloud, indicating a coming out of solution. This information is of great value in that clarity of the recycle stock at lower temperature indicates good solvency and aromaticity of the recycle, plus water affinity. On the other hand, the aniline point of the straight-run stock is poor, clouding much sooner at higher temperature.

The viscosity index comparison gives the ultimate distinction. This is a pure number directly related to lubricating oil value. The higher this number, the less sensitive the viscosity of a material is to temperature change. The virgin stock has an index of PLUS 50. A high quality natural lube would approach 100. A modern synthetic lube of, say, 10W40 grade would approximate 200 or more.

The recycle stock, however, shows a value of MINUS 350 which speaks for itself.

In summary, these results say: in comparing a straight-run with a cracked gas oil of identical volatility, the virgin material is unstable at high temperature, relatively low in viscosity change with temperature, and a poor solvent for the high molecular weight carbenes, asphaltenes and carboids of heavy petroleum stocks, and has a low affinity for water. Indeed, high UOP K materials can be used to precipitate such large molecules, as in "de-asphalting" processes. On the other hand, the recycle stock, while almost solid at ordinary temperature, melts rather sharply at industrial fuel oil temperature, is a very thin liquid at high temperature and mixes readily with water, is stable at high temperature, and is an excellent solvent, diluent, thinner, and viscosity cutter for intractable petroleum. In contrast to pentanes, kerosine, straight-run gas oils, et al., cracked gas oil of essentially diametrically opposite characteristics is ideally suited for its many services as proposed in this patent disclosure.

One final reminder: As the inspection values tabulated in Table II for these two different gas oils are examined, they are seen to differ, diverging more and more markedly for succeeding items. Since the nomenclature, "gas oil" was used for both, predicated on identical boiling characteristics, the only different values postulated were those of UOP K: 12.0 for the straight-run and 10.4 UOP K for the cracked gas oil.

It is to be noted from the typical UOP K ranges tabulated in Table I, as excerpted from p. 4-B of the primary reference, that Mid-continent (mixed-base) crude, Pennsylvania paraffin-base crudes and straight-run stocks vary from 11.6–12.4; likewise from 10.0 to 10.8 for recycle stocks. With the proviso that the instances of overlapping values of UOP K in that tabulation refer to stocks of widely different boiling range—higher for light, volatile materials, lower for heavier, viscous materials—the intent of this disclosure is to include the full ranges of tabulated values for the crude, straight-run and recycle "cracked" products encompassed for the proposed technology.

TABLE II

| | Example of Gas Oils Comparison | | | |
|---|---|---|---|---|
| Chart | Inspection | Units | Straight Run "Virgin" Gas Oil | Cracked "Recycle" Gas Oil |
| | UOP Characterization Factor | UOP K | 12.0 | 10.4 |
| | Engler/ASTM Distillation | | | |
| | Boiling Points: | °F. | | |
| B1a | Initial (IBP) | °F. | 650 | 650 |
| B1a | 10% Vol | °F. | 720 | 720 |
| B1a | 30% Vol | °F. | 776 | 776 |
| B1a | 50% Vol | °F. | 818 | 818 |
| B1a | 70% Vol | °F. | 860 | 860 |
| B1a | 90% Vol | °F. | 932 | 932 |
| B1a | End (EP) | °F. | 1050 | 1050 |
| — | Loss | % Vol | Nil | Nil |
| B1 | SLOPE, 10–90 | °F./% | 2.65 | 2.65 |
| | Boiling Point Averages: | °F. | | |
| B1 | Volume (VABP) | °F. | 821 | 821 |
| B1 | Cubic (CABP) | °F. | 818 | 818 |
| B1 | Mean (MABP) | °F. | 810 | 810 |
| | Densities: | | | |
| B3 | °API | Degrees | 25.3 | 4.2 |
| A3 | Specific Gravity 60/60 | — | 0.902 | 1.043 |
| B3 | Molecular Weight | — | 408 | 316 |
| N2 | Hydrogen | % wt. | 12.85 | 9.08 |
| — | Nominal Formula | — | $C_{29.6}H_{52.0}$ | $C_{24.4}H_{22.8}$ |
| — | H/C Ratio | Atoms/Atom | 1.757 | 0.933 |
| | Kinematic Viscosities: Centistokes (cs.) | | | |
| B7 | @ 100° F. | Cs. | 90 | 700 |
| B6 | @ 122° F. | Cs. | 52 | 280 |
| B5-5a | @ 210° F. | Cs. | 8.0 | 12.0 |
| I2 | @ 500° F. | Cs. | 0.9 | 0.39 |
| | Saybolt Universal Viscosities: Seconds | | | |
| A4 | @ 100° F. | Sec. | 410 | 3100 |
| A4 | @ 122° F. | Sec. | 240 | 700 |
| A4 | @ 210° F. | Sec. | 52 | 66 |
| A4 | @ 500° F. | Sec. | — | — |
| B8 | Aniline Point | °F. | 105 | 52 |
| B4 | Viscosity Index | Units | +50 | −350 |

PHYSICAL APPLICATION OF VISBREAKING PROCESS

The physical use of applicant's medium/heavy cracked gas oil (i.e., the Cracked Recycle Gas Oil) designated in Table II is depicted in FIG. 1. That is to say that FIG. 1 represents a "local" complex of processing facilities 10 located above a subterranean formation 12 of intractable petroleum. Initial contact with the subterranean formation 12 is made by means of an injection well 14 which may be specifically drilled to practice this invention or which may comprise an existing well formerly used for other purposes such as steam injection or the recovery of a mobile petroleum which also may exist in the subterranean formation. In either case, the injection well 14 is generally comprised of an external pipe (or casing) 16 which accommodates a concentric, smaller injection pipe 18 and thereby defines an annular space 20 between the inside wall of the external pipe 16 and the outside wall of the injection pipe 18. The top end 22 of injection well 14 is, in ways well known to this art, so adapted and arranged that fluid inflow, in the form of an injection fluid 24, into injection pipe 18 is segregated from fluid out-flow, in the form of a recovery fluid 26 from the annular space 20 of injection well 14, in the manner generally depicted in FIG. 1. The bottom end 28 of injection well 14 is shown penetrating into the subterranean formation 12 of intractable petroleum. Both the external pipe 16 and the injection pipe 18 can be adjusted in the vertical direction by means not shown in FIG. 1. The bottom end 30 of injection pipe 18 is shown projecting below the bottom end 28 of external pipe 16. This lower position preferably will be the result of a gradual lowering of the injection pipe 18 from some initial higher level 32 as the surrounding intractable petroleum is melted and mixed with incoming injection fluid. As noted in previous portions of this patent disclosure the injection fluid can be any injection fluid capable of melting and/or dissolving (e.g., carbon disulfide could be so employed) an initial portion of the intractable petroleum. As noted in previous portions of this patent disclosure the injection fluid can be any hot, mobile hydrocarbon fluid but a medium/heavy cracked gas oil and especially one having a UOP K value between about 10.0 and about 10.8 is highly preferred.

During start-up operations the lower end 30 of injection pipe 18 will most preferably be positioned (for example, at level 32 as indicated) above the lower end 28 of the external pipe 16. The annular space 20 may also be initially filled with a hot fluid to warm the pipe and surrounding earth. During such start-up operations, circulation of a cutter stock such as a medium/heavy cracked gas oil injected through the top end of injection pipe 18 will deliver the hot injection fluid to the nominal bottom of the injection well 14. That is to say that the injection fluid will flow down through injection pipe 18 to its lower end, which at start-up time is preferably at some level 32 which is preferably located above the lower end 28 of external pipe 16. Hence, the incoming hot cutter stock 24 will first emerge at level 32. Typically level 32 will initially be positioned above the lower end of pipe 16 and the incoming hot fluid will impinge upon local regions of the intractable petroleum bearing material. The resulting material will eventually follow flow path 34 back up through annular space 20 between the casing 16 and the smaller injection pipe 18. Once this circulation is established it will be able to carry more and more heat to the casing and the immediately surrounding earth. Eventually this circulation will also impinge upon and start to melt the solid or highly viscous petroleum near the bottom end of the injection well 14. A mixture begins to form which is composed of the melted petroleum and the injection fluid (e.g., a cutter stock), in any proportions. This mixture, depending on various factors, reaches increasing temperature equilibria with the intractable petroleum which, in turn, becomes progressively more fluid at the higher temperatures. Hence a volume 36 of the subterranean formation containing molten petroleum and cutter stock forms and increases in size as more and more petroleum melts. If a medium/heavy cracked gas oil were used as the cutter stock (injection fluid) then the resulting volume 36 would contain a hot, mobile mixture of medium/heavy cracked gas oil and melted petroleum.

Regardless of the chemical identity of the injection fluid, a frontal interface region 38 of the volume 36 eventually will be established in the subterranean formation 12. That is to say the frontal interface region 38 will be established between the solid, intractable petroleum and the volume 36 of molten petroleum/cutter stock mixture. The flow of injected cutter stock can be increased and the lower end 30 of the injection pipe 18 can be progressively lowered further and further below the lower end 28 of external (casing) pipe 16 and into the midst of the then hot volume 36. Thus, the developing frontal interface region 38 (whose temperature will eventually approximate that of the injection fluid) will be extended farther and farther away from the injection well 14. In one preferred embodiment of this invention a resulting hot, mobile, mixture of medium/heavy cracked gas oil and melted petroleum can be recovered through the annular space 20 and delivered to the visbreaking unit. The hot, mobile medium/heavy cracked gas oil product of the visbreaking unit can then be used as the injection fluid (cutter stock) 24 which is then pumped down injection pipe 18.

As an optional feature a perforated cap or nozzle (not shown) can be installed over the lower end 30 of injection pipe 18, or horizontal drilling can be employed, to direct the flow of injection fluid 24 not only downward, but in a desired lateral direction to aid in the propagation of the frontal interface region 38 in a preferred direction; e.g., in the direction of an offset production well 40 which penetrates the same subterranean formation 12. As previously noted such a production well 40 is preferably pre-filled with a liquid which is preferably at an ambient temperature. When frontal interface region 38 approaches production well 40, measurement of the temperature and/or pressure of the fluid in the production well 40 will indicate, by a rising temperature and/or pressure, the approach of frontal interface region 38. That is to say that when the frontal interface region 38 reaches production well 40, the top hole pressure seen at the top of production well 40 will indicate a melting of the petroleum contiguous to the bottom end 42 of production well 40. When this occurs, the injection well 14 and the production well 40 may be regarded as being in "fluid communication" with each other. At such time an initial start-up phase of the overall production operation may be regarded as complete and one form of "steady state" operation of the complete system can be commenced. However, other forms of steady state production are also possible, e.g., more or less constant production from just an injection well alone, i.e., without the use of a production well. In either case, however, such steady state operation will usually involve the use of the hot, mobile, cracked gas oil product of the local visbreaker as the predominant, if not the exclusive, injection fluid.

During the resulting injection well/production well, fluid communication, form of steady state operation, a production fluid 43 preferably comprised of at least a portion of a resulting hot, mobile, cracked gas oil and melted petroleum mixture will be recovered from production well 40 and eventually become a feedstock 43' for a local visbreaking unit 44. Other feedstock sources might also be employed, but this is a less preferred arrangement. Normally, such a steady state production will change slowly and only minor processing temperature, pressure and flow rate changes will be necessary during this nominal "steady state" operation. The production fluid (feedstock) 43' will preferably first be introduced directly into a circulation coil (see item 78, FIG. 2) of a process furnace component of visbreaker unit 44.

The feedstock 43 preferably proceeds through the remainder of the visbreaking unit 44 in a manner hereinafter more fully described in connection with FIG. 2. In any event, a full range of synthetic cracked products will emerge from the visbreaker unit 44. These products will usually include a non-condensible fuel gas 46 usually containing hydrogen gas as a part of its cracked product. This fuel gas 46 is very suitable for supplying local fuel requirements 46' and, when scrubbed free of objectionable components, for local sale as a utility product and/or return (via line 53) to a conventional refinery 52 as generally indicated by those arrows leading to said refinery 52 (which is assumed to be located some distance away from these local operations). The arrows leaving the blocks indicating the various products of the visbreaking operation which do not feed into line 53, but rather end in space, are used to generally indicate local sale of such products. In any event, cracked $C_3$–$C_4$ products 48, containing straight chain, branched, and olefinic hydrocarbons, also are produced by the visbreaker 44 and they are likewise suitable for return to refinery, sale, further processing and/or petrochemical manufacture. Light cracked liquid products 50 are also produced. They too are suitable for shipment to a conventional refinery 52 (e.g., via pipeline 53) and further processing. Light distillates 54 for blending to domestic fuel oils, aviation jet fuels, diesel fuels or for further processing may also be recovered. Medium/heavy cracked gas oil 56 can be (a) accumulated in storage facility 58 for blending to commercial residual fuel or industrial fuel, especially at that point in time after the injection fluid requirements of this method have been met. However, the injection or recirculation needs for the medium/heavy cracked gas oil are preferably met by a storage tank 59 other than the one (i.e., storage facility 58) used for blending operations. That is to say injection of the medium/heavy cracked gas oil into well 14 is preferably done via a separate storage tank 59 (connected to tank 58 via line 63) and then via a pipeline 60 which leads directly to the inflow 24 of injection well 14. The medium/heavy cracked gas oil can also be introduced into the injection well via passage through a special heater coil 80 in the visbreaker furnace (again, see FIG. 2) which also eventually leads to injection well 14 via line 24. That is to say lines 60 and 24 can be arranged to permit direct transfer of medium/heavy gas oil 56. previously produced by the visbreaker 44 (and accumulated in tank 59) to be delivered (via line 62) to the injection well. However, if for some reason (e.g., the medium/heavy cracked gas oil has become too cold, e.g., less than 400° F.), the medium/heavy cracked gas oil must be heated before injection, this can be done by directing said gas oil through the heating coil 80 of the visbreaking unit 44. To this end, block valve 64 may be used to divert this transfer (via line 66) to the special heater coil 80 in the visbreaking unit 44. It should also be noted in passing that any injection fluid delivered from some outside source 61 can be conveniently delivered to storage tank 59 for direct injection via line 62 or for heating before injection via line 66, coil 80, and line 24. As previously noted this injection fluid need not necessarily be medium/-heavy cracked gas oil.

In any event, the injection fluid 65 (e.g., medium/-heavy cracked gas oil) is preferably sent to line 24 in a heated condition (400° F. to 1000° F.). However, it could also be sent to injection well 14 "cold", via line 62. In its preferred heated condition it can more readily propagate the molten volume 36 in the petroleum formation 12. In other circumstances the medium/heavy cracked gas oil 56 can be blended (via dotted line 69) directly with the heavy residual product 68 of the visbreaking operation and sent, as finished specification industrial fuel 70, to local sales. Indeed, the possible end uses of even the most important products of such visbreaking operations (again, other products are also possible) are so varied and complex that they are best presented in the form of a use/material matrix such as the one depicted in FIG. 3. Some of the other possible material/use possibilities will be discussed in later portions of this patent disclosure.

Figure 2:
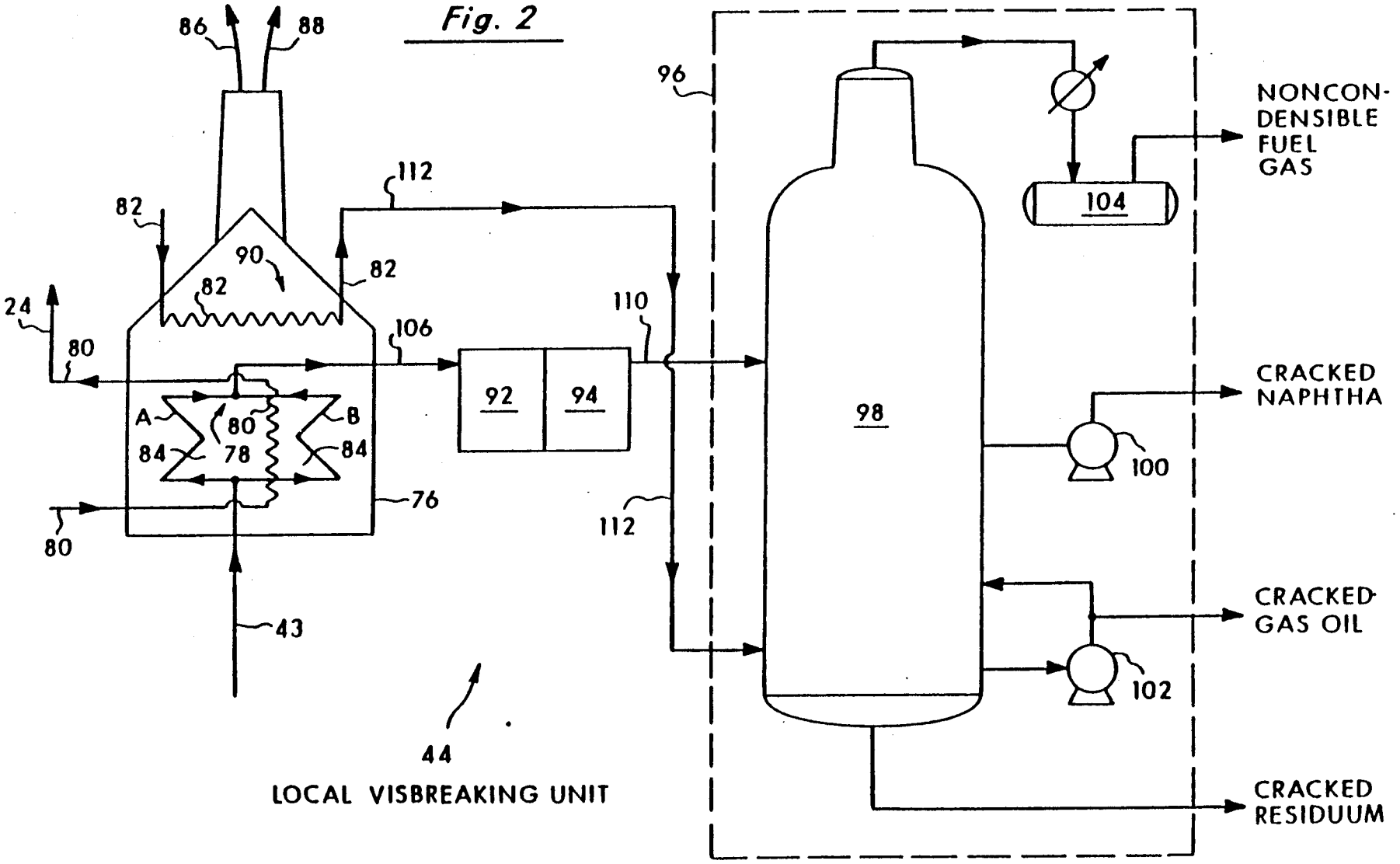
FIG. 2 is a flow diagram of the operation of a visbreaking unit especially adapted for operation upon the intractable petroleum which is the subject of the methods of this patent disclosure.

FIG. 2 depicts operation of the visbreaking unit 44 more or less in its steady state mode of operation as opposed to its start-up mode of operation. Again, changes in such steady state operation will usually be, for all intents and purposes, so slow as to allow for small changes in flow rates, temperatures, pressures, etc., so that steady state operation will usually involve only occasional, minor adjustments. Such adjustments may even be predetermined, and hence preprogrammed to a large degree. The most essential pieces of process equipment depicted in FIG. 2 include a high temperature process heater 76 whose size will depend on petroleum production rates and auxiliary requirements. Process heater 76 which will preferably have three or more distinct sets of tubing, e.g., 78, (A, B, etc.) 80 and 82. Two or more sets of this tubing are preferably in a radiant heating section 84 of process heater 76, They are generally designated as coil tubing 78 (having legs A, B, etc.) and coil tubing 80. Preferably coil tubing 78 and coil tubing 80 are each capable of heating materials to temperatures of up to about 1,000 degrees F. A third coil 82 preferably will be located in a convection chamber 90 passing stack gases 86 and 88. This convection heater coil 82 is preferably capable of an absorption of waste heat of such stack gases down to temperatures of about 400 degrees F.

A series of vessels 92, 94, etc. will receive the heated thru-put of radiant coil 78 (A, B, etc.) so that precise flow rates, residence times, temperatures and introductions of cooling liquids can be employed to limit precisely the extent of visbreaking actions and thereby provide thermally cracked products without production of coke. A complex 96 consisting of a multi-stage rectification column 98 and its ancillaries, e.g., pump(s) 100, 102, receiver(s) 104, pipes, etc. will complete the essential equipment of the overall local visbreaking unit 44.

It should again be noted that radiant heater coil 80 will have separate external connections from surface storage tanks and piping facilities (e.g., from tank 59, via line 66) in order to heat a succession of injection fluids. Again, such injection fluids may comprise cutter stock received from outside sources 61, internally produced medium/heavy cracked gas oil 56 and/or finished residual fuel 71 delivered via line 73 and/or mixtures of such fluids. It should also be noted in passing that convection coil 82 will be the primary facility for production of process and utility steam for use in operation of such local utilities as pumps, rectification equipment (e.g., via line 112) and so forth. Such steam may also be sold locally.

After the visbreaking unit 44 is in operation thermal cracked noncondensible gases 46' can be directed to the process heater 76 for use as said heater's fuel. Perhaps the most essential function of visbreaking unit 44 will be to receive in radiant coil 78 (A, B, etc.) a production fluid 43' from production well 40, which will comprise a molten mixture of petroleum product and its associated cutter stock.

The reaction product stream emerging from coil 78 (A, B, etc.) then will enter, via pipe 106, a vessel complex 92, 94, etc. where the overall reaction is completed and quenched. Thereafter, via transfer line 110, the entire cracked effluent stream (which may consist of a complete spectrum of volatiles) will enter as a feed stock to a rectifier 98. There the fractions will be recovered by rectification to produce the various products previously noted. Note also that process steam 112 which may be produced by energy released by the overall visbreaking process can be employed in the rectification column 98 for stripping purposes where required. Steam utilization of this type is often referred to as "process" purposes in the oil refining industry.

FIG. 3 depicts a use/material matrix for some of the more important fractions produced by local visbreaking of an intractable petroleum feedstock. The various end uses are generally associated with a function and location (e.g., heating and injection via line 66) in the overall visbreaking/injection well system. Those skilled in this art will appreciate that the spectrum of possible products of such a visbreaking operation which are shown on the product axis of the product/end use matrix of FIG. 3, from fuel gas to residuum, should not be regarded as all inclusive (again, many other products can be obtained from this visbreaking operation) or clearly defined since there is usually some overlapping of such products (e.g., fuel gas may be present in the LPG fraction, lite distillates may be present with the medium/-heavy cracked gas oil, etc.).

While certain preferred embodiments of these methods have been described above, it should be appreciated that they are given only by way of illustration. They are not intended as limitations since this patent disclosure is intended to cover all modifications, alternatives and equivalents falling within the scope and spirit of this invention as expressed in the appended claims.

Thus having disclosed my invention, I claim:

1. A method for producing petroleum from a subterranean formation of intractable petroleum, said method comprising:

(1) constructing and operating a local visbreaking unit above the subterranean formation;

(2) starting production of intractable petroleum from the subterranean formation by: (a) injecting a start-up injection fluid obtained from a source other than intractable petroleum production from the local visbreaking unit, (b) obtaining an initial portion of intractable petroleum from, the subterranean formation and (c) introducing the initial portion of the intractable petroleum from the subterranean formation into the local visbreaking unit;

(3) visbreaking the initial portion of petroleum recovered from the subterranean formation in order to obtain a first portion of a medium/heavy cracked gas oil fractionated by the visbreaking unit in a temperature range of from about 400° F. to about 1000° F. and having a UOP K Factor between about 10.0 and about 10.8;

(4) injecting, in the form of a hot liquid having a temperature from about 400° F. to about 1000° F. and by means of an injection well penetrating said subterranean formation, at least a part of the first portion of medium/heavy cracked gas oil having a UOP K Factor between about 10.0 and about 10.8 in order to impinge upon and melt a subsequent portion of the intractable petroleum and thereby forming a resulting hot, mobile, mixture of medium/heavy cracked gas oil and melted petroleum;

(5) recovering the resulting hot, mobile, mixture of medium/heavy cracked gas oil and melted petroleum from the subterranean formation;

(6) introducing the resulting hot, mobile, mixture of medium/heavy cracked gas oil and melted petroleum into the visbreaking unit in order to obtain a second portion of medium/heavy cracked distillate gas oil having a temperature between about 400° F. and about 1000° F. and a UOP K Factor between about 10.0 and about 10.8; and (7) injecting at least a part of the second portion of medium/heavy cracked gas oil into the subterranean formation in order to melt and recover subsequent portions of the intractable petroleum.

2. The method of claim 1 wherein the start-up injection fluid is of a different chemical species and has a different UOP K Factor than the medium/heavy cracked gas oil recovered from the local visbreaking unit.

3. The method of claim 1 wherein the start-up injection fluid is a medium/heavy cracked gas oil of the same chemical species as, and having substantially the same UOP K as, a medium/heavy cracked gas oil recovered from a visbreaking unit other than the local visbreaking unit.

4. The method of claim 1 wherein the medium/heavy cracked gas oil is injected into the injection well at temperatures ranging from about 400° F. to about 1000° F. and at pressures ranging from about 100 PSIG to about 2,000 PSIG.

5. The method of claim 1 wherein the resulting hot, mobile, mixture of medium/heavy cracked gas oil and melted petroleum is recovered via an injection well.

6. The method of claim 1 wherein the resulting hot, mobile, mixture of medium/heavy cracked gas oil and melted petroleum are recovered via an injection well which is comprised of an injection pipe centrally positioned in a pipe having a larger diameter to define an annulus through which the resulting hot, mobile, mixture is recovered.

7. The method of claim 1 wherein the resulting hot, mobile, mixture of medium/heavy cracked gas oil and melted petroleum is recovered via an offset recovery well.

8. The method of claim 1 wherein the resulting hot, mobile, mixture of medium/heavy cracked gas oil and melted petroleum is recovered via two or more offset recovery wells.

9. The method of claim 1 wherein operation of the visbreaking unit yields a noncondensible fuel gas which is used to fuel the visbreaking unit.

10. The method of claim 1 wherein operation of the visbreaking unit yields a noncondensible fuel gas in quantities sufficient to meet the fuel requirements of the visbreaking unit and to provide a noncondensible fuel gas product for local sale.

11. The method of claim 1 wherein operation of the visbreaking unit yields a noncondensible fuel gas from which hydrogen is produced and then employed to cleanse distillate products yielded from said visbreaking unit.

12. The method of claim 1 wherein operation of the visbreaking unit yields a volatile cracked naphtha which is transferred to a complete refining facility for further processing and incorporation into a commercial motor fuel.

13. The method of claim 1 wherein operation of the visbreaking unit yields a light cracked intermediate distillate product which is transferred to a complete refining facility for further processing and incorporation into a fuel product.

14. The method of claim 1 wherein operation of the visbreaking unit yields medium/heavy cracked distillate gas oil which is locally blended with a heavy cracked residual product of the visbreaking operation in order to make a heavy residual industrial fuel.

15. The method of claim 1 wherein operation of the visbreaking unit yields medium/heavy cracked gas oil, in excess of injection requirements, which is transported to a complete refining facility for further processing and sale.

16. The method of claim 1 wherein operation of the visbreaking unit yields saturated and unsaturated $C_3$ and $C_4$ hydrocarbons which are sold locally as a LPG product.

17. The method of claim 1 wherein operation of the visbreaking unit yields saturated and unsaturated $C_3$ and $C_4$ hydrocarbon products which are transported to a complete refining facility for further processing and sale.

18. The method of claim 1 wherein operation of the visbreaking unit yields products whose sensible heats are combined with convection heat produced by a local cracking furnace to produce steam and electricity locally.

19. The method of claim 1 wherein an existing well into the subterranean formation is used as the injection well.

20. The method of claim 1 wherein the medium/heavy cracked gas oil injected into the subterranean formation is supplemented by compressed air.

21. The method of claim 1 wherein the medium/heavy cracked gas oil injected into the subterranean formation is supplemented by hot water.

22. The method of claim 1 wherein the medium/heavy cracked gas oil injected into the subterranean formation is supplemented by steam.

23. The method of claim 1 wherein the medium/heavy cracked gas oil injected into the subterranean formation is supplemented by a residual product of the visbreaking unit.

24. A method for starting production of petroleum from a subterranean formation of intractable petroleum, said method comprising:

(1) constructing and operating a local visbreaking unit above the subterranean formation:

(2) drilling and completing an injection well to the subterranean formation of intractable petroleum;

(3) introducing a smaller concentric pipe into the injection well to define an annular space between the outside of the smaller concentric pipe and the inside of the well through which fluids can rise in the well;

(4) preheating the well by flooding the annular space with a hot, mobile, injection fluid and starting production of petroleum from the subterranean formation by:

(a) injecting a start-up hot, mobile, injection fluid into the smaller concentric pipe in order to impinge said fluid upon an exposed surface of the intractable petroleum and thereby forming a resulting hot, mobile, mixture of injection fluid and melted petroleum;

(b) recovering the resulting hot, mobile, mixture of injection fluid and melted petroleum from the subterranean formation by continuous injection of the injection fluid into the smaller concentric pipe and continuous recovery of the resulting hot, mobile, mixture of starter fluid and melted petroleum through the annular space;

(c) progressively lowering the smaller concentric pipe in the well in order to attack progressively more distant regions of the intractable petroleum and hence progressively increasing volumes of the subterranean formation which are exposed to the resulting hot, mobile, mixture of injection fluid and melted petroleum; and (d) introducing the resulting hot, mobile, mixture of injection fluid and melted petroleum recovered through the annular space of the injection well to the visbreaking unit;

(5) visbreaking the resulting hot, mobile, mixture of injection fluid and melted petroleum in order to produce a medium/heavy cracked gas oil fractionated by the visbreaking unit in a temperature range of from about 400° F. to about 1000° F. and having a UOP K Factor between about 10.0 and about 10.8; and (6) injecting at least a portion of the medium/heavy cracked gas oil having a temperature range of from about 400° F. to about 1,000° F. and having a UOP K Factor between about 10.0 and about 10.8 into the smaller concentric pipe in order to melt and recover subsequent portions of the intractable petroleum.

25. The method of claim 24 wherein the start-up hot, mobile, injection fluid is of a different chemical species and has a different UOP K Factor than the medium/heavy cracked gas oil recovered from the local visbreaking unit.

26. The method of claim 24 wherein the start-up hot, mobile, injection fluid is a medium/heavy cracked gas oil of the same chemical species and having substantially the same UOP K as, a medium/heavy cracked gas oil recovered from a visbreaking unit other than the local visbreaking unit.

27. The method of claim 24 wherein the hot, mobile injection fluid is a hydrocarbon material which is liquid at temperatures ranging from about 400° F. to about 1000° F. at pressures of from about 100 PSIG to about 2000 PSIG and which is capable of at least partially solubilizing the intractable petroleum under said temperature and pressure conditions.

28. The method of claim 24 wherein the hot, mobile injection fluid is a medium/heavy cracked gas oil produced by a petroleum refinery unit other than the local visbreaking unit.

29. The method of claim 24 which further comprises drilling at least one offset production well which penetrates the subterranean formation.

30. The method of claim 24 which further comprises drilling at least one offset production well which penetrates the subterranean formation, filling the production well with a mobile fluid and observing the production well's wellhead pressure in order to determine when the resulting hot, mobile, mixture of injection fluid and melted petroleum comes into fluid communication with the recovery well and thereby indicating that the hot, mobile injection fluid can be replaced with another injection fluid having a lower volatility than that of the injection fluid.

31. The method of claim 24 which further comprises drilling at least one offset production well which penetrates the subterranean formation, filling the production well with a mobile fluid and observing the production well's wellhead temperature to determine when a resulting hot, mobile, mixture of start-up injection fluid and melted petroleum comes into fluid communication with the recovery well and thereby indicate when the hot, mobile injection fluid can be progressively replaced with more and more of a medium/heavy cracked distillate gas oil component produced by the local visbreaking unit.

32. The method of claim 24 wherein the smaller concentric pipe is provided with means for directing the hot, mobile injection fluid toward an offset, recovery well which penetrates the subterranean formation.

33. The method of claim 24 wherein the medium/heavy cracked gas oil injected into the subterranean formation is supplemented by compressed air.

34. The method of claim 24 wherein the medium/heavy cracked gas oil injected into the subterranean formation is supplemented by hot water.

35. The method of claim 24 wherein the medium/heavy cracked gas oil injected into the subterranean formation is supplemented by steam.

36. The method of claim 24 wherein the medium/heavy cracked gas oil injected into the subterranean formation is supplemented by a residual product of the visbreaking unit.

* * * * *